US007986887B2

(12) United States Patent
Suda

(10) Patent No.: US 7,986,887 B2
(45) Date of Patent: Jul. 26, 2011

(54) IMAGE FORMING APPARATUS

(75) Inventor: Yasuhiro Suda, Fukushima (JP)

(73) Assignee: Oki Data Corporation, Tokyo (JP)

( * ) Notice: Subject to any disclaimer, the term of this patent is extended or adjusted under 35 U.S.C. 154(b) by 395 days.

(21) Appl. No.: 12/213,547

(22) Filed: Jun. 20, 2008

(65) Prior Publication Data

US 2008/0317478 A1 Dec. 25, 2008

(30) Foreign Application Priority Data

Jun. 22, 2007 (JP) ..... 2007-165094

(51) Int. Cl.
*G03G 15/00* (2006.01)
*G03G 15/08* (2006.01)

(52) U.S. Cl. ..... 399/10; 399/12; 399/13; 399/25; 399/27

(58) Field of Classification Search ..... 399/10, 399/12, 13, 25, 27
See application file for complete search history.

(56) References Cited

U.S. PATENT DOCUMENTS 5,528,344 A * 6/1996 Yamaguchi et al. ..... 399/13
6,954,595 B2 * 10/2005 Tsukida et al. ..... 399/12
6,967,733 B1 * 11/2005 Minowa ..... 358/1.15
7,068,956 B2 * 6/2006 Tsukida et al. ..... 399/27
7,177,553 B2 * 2/2007 Ono ..... 399/12
2002/0001100 A1 * 1/2002 Kawanabe ..... 358/1.15
2002/0094206 A1 * 7/2002 Igarashi et al. ..... 399/8
2003/0040984 A1 * 2/2003 Inami et al. ..... 705/27
2006/0061808 A1 * 3/2006 Miyahara et al. ..... 358/1.15
2006/0216046 A1 9/2006 Hatakeyama
2008/0085129 A1 * 4/2008 Okimura et al. ..... 399/13

FOREIGN PATENT DOCUMENTS

JP 2006-267528 10/2006
JP 2007-094155 4/2007

* cited by examiner

*Primary Examiner* — David M Gray
*Assistant Examiner* — Francis Gray
(74) *Attorney, Agent, or Firm* — Rabin & Berdo, P.C.

(57) ABSTRACT

An image forming apparatus is supplied capable of adopting low price structure to obtain information that is stored in a storing section and is used for analyzing reason of failure/repair. The image forming apparatus performs an image formation by using an exchanging unit having a mounting section to mount an unit information store use memory and stores unit information including use status of the exchanging unit into the unit information store use memory, and comprises a history information storing section in which history information of the image forming apparatus is stored; an apparatus information store use memory which is mounted onto the mounting section to replace the unit information store use memory; a judging section which judges which of the unit information store use memory and the apparatus information store use memory is mounted in the mounting section; and a store controlling section which controls the apparatus information store use memory to store the history information in the case that the apparatus information store use memory is judged being mounted.

13 Claims, 15 Drawing Sheets

| ADDRESS | AREA DIVISION |
|---|---|
| 000000H | GENERAL-PURPOSE STORE AREA |
| 7FFFC0H<br>7FFFFFH | LOG HISTORY INFORMATION STORING AREA |

*FIG. 5*

| ADDRESS | AREA DIVISION |
|---|---|
| 00H | APPARATUS MANUFACTURE NUMBER STORE AREA |
| | TOTAL PRINT SHEET NUMBER STORE AREA |
| | |
| | SETTING INFORMATION STORING AREA |
| | HINDRANCE HISTORY INFORMATION STORE AREA |
| 3FH | |

*FIG. 6*

| ADDRESS | AREA DIVISION | | |
|---|---|---|---|
| 00H | EXCHANGING UNIT NAME STORE AREA | EXCHANGING UNIT IMMANENT INFORMATION STORE AREA | MEMORY PAGE 0 |
| | TONER FILLING AMOUNT STORE AREA | | |
| | RECYCLE TIME STORE AREA | | |
| | MANUFACTURE DATE STORE AREA | | |
| | USE START DATE STORE AREA | EXCHANGING UNIT USE STATE INFORMATION STORE AREA | |
| | APPARATUS MANUFACTURE NUMBER STORE AREA | | |
| | TONER USE AMOUNT STORE AREA | | |
| 7FH | UNIT EXCHANGE INFORMATION STORE AREA | | |
| 80H<br>87H | EXCHANGING UNIT ID | MEMORY IDENTIFICATION INFORMATION STORE AREA | MEMORY PAGE 1 |

*FIG. 7*

| | | | | | | | |
|---|---|---|---|---|---|---|---|
| 0121 | 0000 | 002C | 0000 | 01F5 | 0000 | 0047 | 0002 |
| 02FF | 2020 | 0033 | 0003 | 0161 | 0003 | 011C | 0004 |
| 011C | 0005 | 0058 | 0005 | 0176 | 0020 | 0174 | 0006 |
| 0174 | 0100 | 011C | 0006 | 011D | 0008 | 029E | 0000 |

*FIG. 9A*

| | | |
|---|---|---|
| pumaddif.c | pum_ev_sns1_p | IN Sensor1 ON -> OFF |
| heater.c | eng_heatctl_p | HEATER PROCESS HEATER ON<br>HEATPON: stpchg_p(HTSTRTSTEP)printf=0 |
| pumaddif.c | pum_ev_httemp_r_p | Event41 HEATER TEMPERATURE<br>(LOWCONT_F HT_TEMP_C) |
| pumamain.c | pum_pow_menuread_10 | MENU EEPROM READ END<br>282 pum_opt_idread_p START |
| pse206_9.h | pum_odev_read1_p | LED HEAD EEPROM READ START |
| leisusmh.c | lrx_ROMNOR_p/lrx_VERSIONR_p | APPARATUS VERSION NUMBER READ<br>Read ROM Revision No |
| leisusmh.c | lrx_CONF_p | Configuration SETTING COMMAND<br>eng_ctlinfo_c SET |
| leisusmh.c | lrx_SSI01_p | OPTION TRAY ERROR INFORMATION READ |
| ~~pse206_9.h~~ | ~~eng_headalarm_p~~ | ~~LED HEAD CHECK SUM ERROR~~ |
| pumamain.c | pum_pow_200x | POWER ON PROCESS END |
| pumamain.c | eng_alarm_p | ALARM STOP PROCESS<br>tm_ptr STORE pum_func_t |
| pumamain.c | pum_almstop_10 | ALARM STOP PROCESS<br>DRUM STOP CONFIRMATION |
| pumamain.c | pum_set_t_inID_maxmin_p | toner_in_ID CORRECTION MIN PRE-VALUE |
| leisusmh.c | lrx_CTLSET_p | Control Setpoint SET COMMAND<br>ctl * 256 + length |
| pumamain.c | pum_tnid_pow_50 | APPARATUS ID UN-SET +3 |
| heater.c | eng_heatctl_p | HEATSTOP:stpchg_p(HTSTOPSTEP) |

*FIG. 9B*

104a

| ADDRESS | AREA DIVISION |
| --- | --- |
| 00H | APPARATUS MANUFACTURE NUMBER STORE AREA |
| | TOTAL PRINT SHEET NUMBER STORE AREA |
| | |
| | SETTING INFORMATION STORING AREA |
| | HINDRANCE HISTORY INFORMATION STORE AREA |
| 7FH | |

*FIG. 15*

IMAGE FORMING APPARATUS

BACKGROUND OF THE INVENTION

1. Field of the Invention

The invention relates to an image forming apparatus which uses exchanging unit having a mounting section to mount store medium and performs an image formation, further stores predetermined information into the store medium.

2. Related Background Art

Conventionally, a kind of image forming apparatus is supplied which uses toner cartridge on that a store medium is mounted to perform an image formation, for example, as disclosed by a patent document 1. The image forming apparatus stores information concerning with use of apparatus body, such as apparatus identification number of the image forming apparatus, print sheet number in the image forming apparatus, and use period of the toner cartridge into the store medium. After the toner cartridge is collected, the information is read out from the store medium in order to make maker grasp use status about consumption such as toner of the image forming apparatus and the like, for obtaining a better future design.

And yet, the image forming apparatus has a hindrance detecting section for detecting hindrance generated in respective sections of the apparatus body, and stores all kind of the detected hindrances into a non-volatility memory of the apparatus body, as hindrance history. Further, when the hindrance is detected, the image forming apparatus displays a hindrance notification scene onto a displayer provided in the apparatus body for notifying user of occurrence of the hindrance. Then, the user refers to the hindrance notification scene displayed on the displayer to dispose the hindrance, in the case that the user could not dispose it, the user requests management center to dispatch worker. The dispatched worker refers to the hindrance notification scene displayed on the displayer and hindrance history information that is stored in the memory of the apparatus body and is displayed on the displayer through operating, and performs a restoration work about the hindrance.

On the one hand, as stated above, the hindrance history information stored in the memory of the image forming apparatus is displayed onto the displayer provided in the apparatus body through operation of the worker when hindrance occurs or whenever maintenance or management check is needed at a certain period, and is used for grasping the hindrance status through the worker performs work.

On the other hand, on the side of maker, through using report and the like from the worker, information about the hindrance generated in the image forming apparatus can be collected. However, the information is not sufficient for improving design technology and maintenance/management technology, so it is desired to obtain the hindrance history information stored in the memory of the apparatus body.

Patent document 1: Japan patent publication 2006-267528.

However, in the image forming apparatus using exchanging unit on which store medium is mountable, it can be considered to store the hindrance history information stored in the memory into the store medium mounted on the exchanging unit, but, because the information amount of the hindrance history information memorized in the memory is large, it is necessary to prepare a store medium with large capacity. So that a problem exists that cost becomes high.

Further, as another method, it can be considered to furnish an interface section in the image forming apparatus for mountably and removably connecting an external store medium prepared by worker; or furnish a communication function capable of performing wireless communication with an information processing terminal, then, through operation of worker with respect to the apparatus body, to store the hindrance history information memorized in the memory into the external store medium mounted on the interface section; or to transmit the hindrance history information to the information processing terminal by wireless communication. However, because it is necessary to add these functions into the apparatus body, also there is a problem that cost becomes high.

SUMMARY OF THE INVENTION

It is, therefore, an object of the invention to provide an image forming apparatus capable of solving the above problem. That is, in such an image forming apparatus which performs image formation through using exchanging unit having a mount section to mount store medium and store predetermined information into the store medium, information that is memorized in a memory of apparatus body and is used for reason analysis of failure/restore can be obtained by using a low price structure.

According to the present invention, there is provided an image forming apparatus which performs an image formation by using an exchanging unit having a mounting section to mount an unit information store use memory and stores unit information including use status of the exchanging unit into the unit information store use memory, comprising:

a history information storing section in which history information of the image forming apparatus is stored;

an apparatus information store use memory which is mounted onto the mounting section to replace the unit information store use memory;

a judging section which judges which of the unit information store use memory and the apparatus information store use memory is mounted in the mounting section; and a store controlling section which controls the apparatus information store use memory to store the history information in the case that the apparatus information store use memory is judged being mounted.

Moreover, in the image forming apparatus, the history information may at least include hindrance history information representing history of hindrance in the image forming apparatus, and operation history information representing operation log of the image forming apparatus.

Moreover, in the image forming apparatus, the exchanging unit may be a process cartridge; a toner cartridge or an ink cartridge.

Moreover, in the image forming apparatus, the apparatus information store use memory may be an EEPROM or a flash memory.

Moreover, in the image forming apparatus, the operation history information is log of the image forming apparatus.

Moreover, the image forming apparatus may further comprise a history information dividing section which divides the history information into plural divided history information on the basis of a usable capacity of the of the apparatus information store use memory when an amount of the history information exceeds the usable capacity of the apparatus information store use memory; and a divided history information storing section which stores the plural divided history information, wherein the store controlling section controls the apparatus information store use memory to sequentially store the respective divided history information whenever the apparatus information store use memory is mounted by the mounting section.

Moreover, in the image forming apparatus, the history information divided section may generate such divided history information which is assigned a header information representing a division sequence, and a flag information representing whether the divided history information is final or not.

The above and other objects and features of the present invention will become apparent from the following detailed description and the appended claims with reference to the accompanying drawings.

BRIEF DESCRIPTION OF THE DRAWINGS

FIG. 5 is a diagram showing a structure of a RAM in embodiment of the present invention;

FIG. 6 is a diagram showing a structure of a body non-volatility memory in embodiment of the present invention;

FIG. 7 is a diagram showing a structure of a unit information store use memory in embodiment of the present invention;

FIG. 9A is a diagram showing an example of log history information;

FIG. 9B is a diagram showing an analysis result of the log history information in embodiment of the present invention;

FIG. 15 is a diagram showing a structure of a body non-volatility memory in transformation example of the present invention.

DETAILED DESCRIPTION OF THE PREFERRED EMBODIMENTS

Embodiments of the invention will be described in detail hereinbelow with reference to the drawings.

Embodiment

Figure 1:
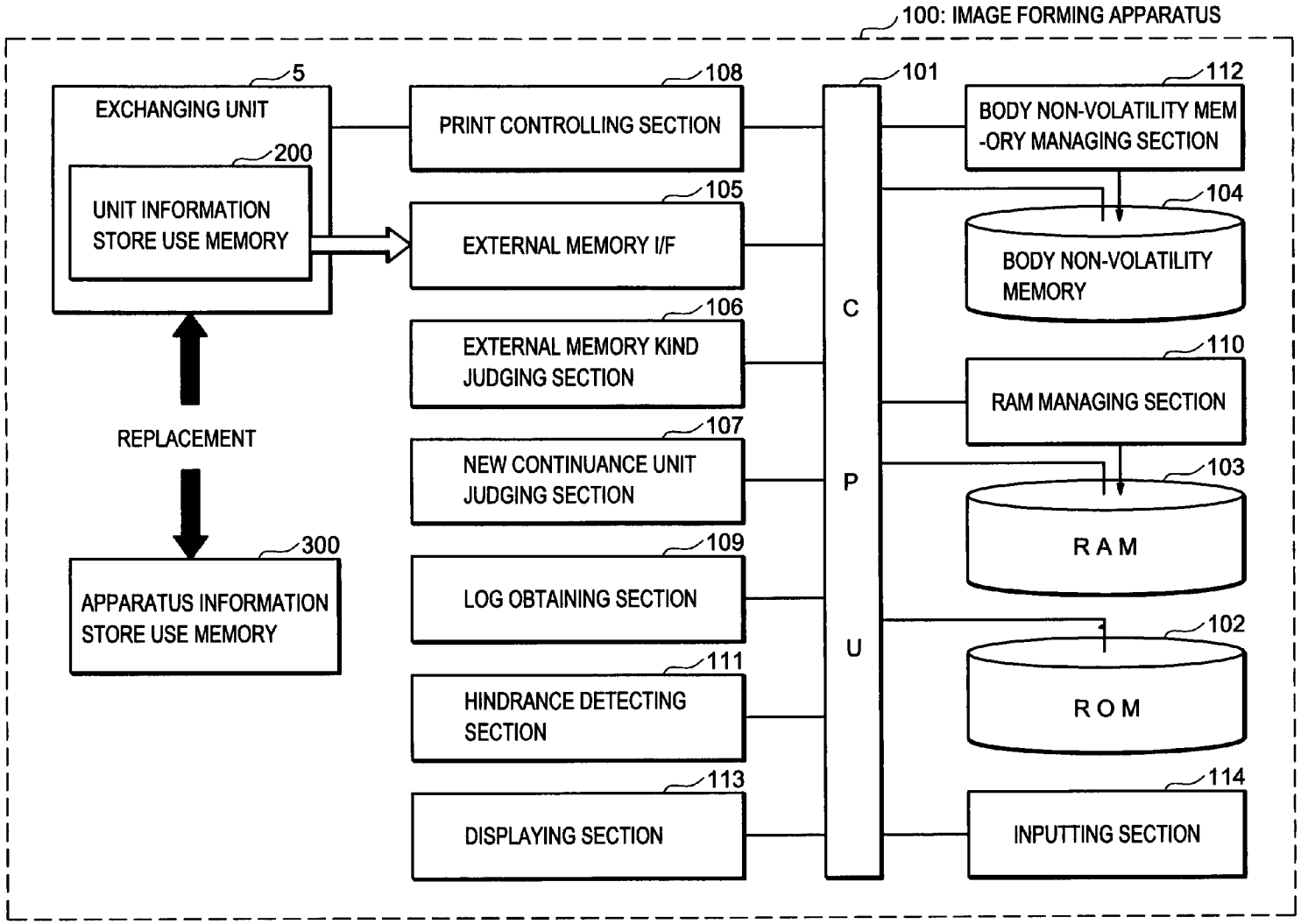
FIG. 1 is a block diagram of an image forming apparatus in embodiment of the present invention.
Figure 2:
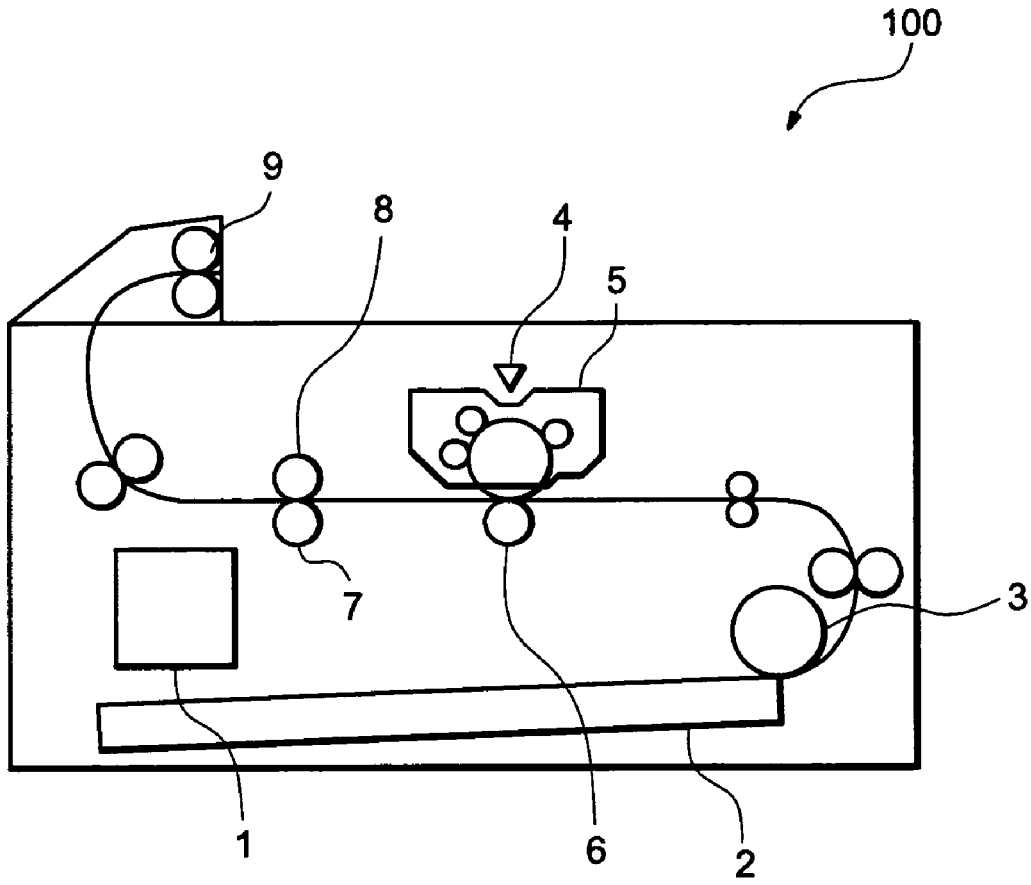
FIG. 2 is a structure block diagram of an image forming apparatus in the case that it serves as a printer.

FIG. 1 is a block diagram of an image forming apparatus in embodiment of the present invention; FIG. 2 is a structure block diagram of an image forming apparatus in the case that it serves as a printer; and FIG. 3 is a structure block diagram of an exchangeable or exchanging unit in the case that it is a process cartridge.

Figure 3:
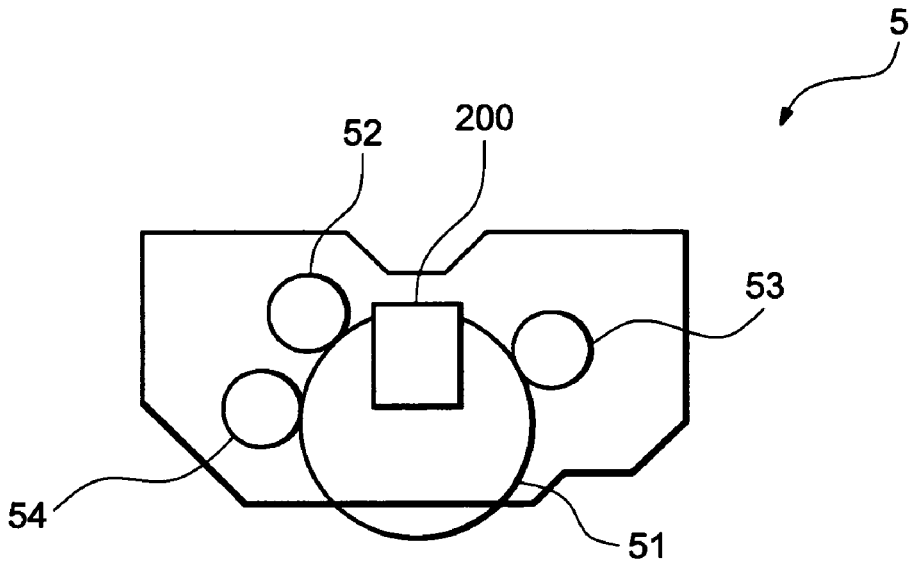
FIG. 3 is a structure block diagram of an exchanging unit in the case that it is a process cartridge.

An image forming apparatus 100 in the embodiment of the present invention is a printer to perform an image formation on the basis of image data obtained from, for example, an upper apparatus such as PC (Personal Computer) and the like connected with network, regarding structure of the image forming apparatus 100 when it is printer and functions of its respective sections, they are explained by using FIGS. 2 and 3. The image forming apparatus 100 is used in office and the like.

The image forming apparatus 100, as a printer, as shown by FIG. 2, comprises a control substrate 1 on which a CPU 101 that is used for controlling the whole image forming apparatus 100 and will be described below, various memories and the like are mounted; a paper feed tray 2 for loading and holding print medium; a feeding roller 3 for feeding print medium in an upmost position of the paper feed tray 2 to a conveyance route; a LED (Light Emitting Diode) head 4 to form print area on the surface of a photosensitive drum 51 described below through exposing the surface of the photosensitive drum 51 on the basis of image data held in a RAM (Random Access Memory) 103 that is mounted on the control substrate 1 and is described below; an exchanging unit 5 serving as a process cartridge that is composed of plural parts used for image formation and supplies toner accommodated in a toner tank 53 described below to the print area so as to form toner image; a transferring roller 6 that is furnished as facing and pressing to the photosensitive drum 51 and transfers the toner image formed on the surface of the photosensitive drum 51 onto print medium conveyed along the conveyance route; a pressing roller 7; a fixing roller 8 that is furnished as facing and contacting to the pressing roller 7 and is used for fixing the toner image transferred on the print medium by using heat; and an ejecting roller 9 used for ejecting the print medium from apparatus body after fixing process.

The exchanging unit 5, as a process cartridge, as shown by FIG. 3, comprises a photosensitive drum 51; a charging roller 52 for charging the photosensitive drum 51; a toner tank 53 to accommodate toner supplied to the surface of the photosensitive drum 51 on which print area is formed by exposure of the LED head 4; a remainder toner collecting section 54 for scraping off and collecting remainder toner remaining on the surface of the photosensitive drum 51 after the toner image is transferred onto the print medium; and a mounting section not shown for mounting a unit information store use memory 200 which will be described below or an apparatus information store use memory 300 which will be described below onto the exchanging unit 5.

Figure 4:
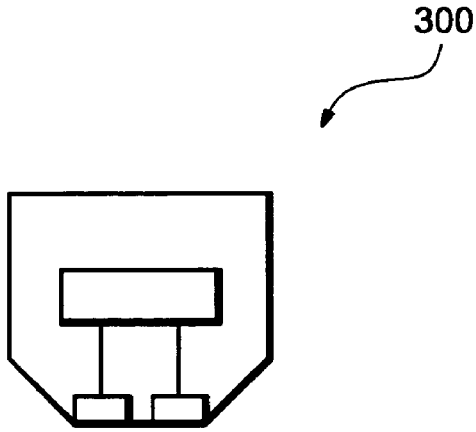
FIG. 4 is a diagram showing an example of appearance of an apparatus information store use memory in embodiment of the present invention.

FIG. 4 is a diagram showing an example of appearance of an apparatus information store use memory in embodiment of the present invention.

In the embodiment of the present invention, as the exchanging unit 5, though only such a structure using a process cartridge is disclosed, it is not be limited in this case, it is possible to use a structure of toner cartridge or ink cartridge composed of toner tank 53.

Next, regarding control structure of the image forming apparatus 100, it is explained by using the block diagram of FIG. 1.

The image forming apparatus 100, as shown by FIG. 1, comprises a CPU (Central Processing Unit) 101 to control the whole apparatus; a ROM (Read Only Memory) 102, a RAM 103; a body non-volatility memory 104; an external memory I/F (Interface) 105 for performing communication with the unit information store use memory 200 or the apparatus information store use memory 300 mounted on the exchanging unit 5 serving as process cartridge; an external memory kind judging section 106; a new continuance unit judging section 107; a print controlling section 108; a log obtaining section 109; a RAM managing section 110; a hindrance detecting section 111; a body non-volatility memory managing section 112; a displaying section 113; and an inputting section 114.

Here, the CPU 101 synchronizes respective sections in the image forming apparatus 100 with clock signal outputted from the CPU 101 and controls the whole apparatus.

The ROM 102 is formed from a non-volatility memory, and is a memorizing section to memorize information of read exclusiveness of various programs and the like used by the CPU 101 to control the whole image forming apparatus 100.

FIG. 5 is a diagram showing a structure of a RAM in embodiment of the present invention.

The RAM 103, as shown by FIG. 5, has a store capacity of 8 mega bytes, and is composed of a general-purpose store area used while the CPU 101 controls the whole image forming apparatus 100, and a log history information storing area to store log history information serving as operation record of image forming apparatus 100. Here, the RAM 103 is formed from a volatility memory which will lose store content when power source (not shown) in the apparatus body is turned off.

FIG. 6 is a diagram showing a structure of a body non-volatility memory in embodiment of the present invention.

The body non-volatility memory 104, as shown by FIG. 6, has a capacity of 64 bytes, and is composed of an apparatus manufacture number store area to store apparatus manufacture number of the apparatus body, which is previously set by maker who manufactured the image forming apparatus 100; a total print sheet number store area to store total print sheet number of the apparatus, which is calculated by a print sheet number counting section (not shown) in the apparatus body; a setting information storing area to store independent various settings, selection items and the like of the apparatus body; a hindrance history information store area to store hindrance history information serving as histories of various hindrances or malfunctions that occurred in apparatus body, are detected by the hindrance detecting section 111 and is described below. Here, the hindrance history information is composed of, for example, error codes of various hindrances, hindrance name representing content of various hindrances, and detection date of various hindrances.

The external memory I/F 105 is a interface section for removably connecting the unit information store use memory 200 or the apparatus information store use memory 300 that is mounted on a mounting section (not shown) in the exchanging unit 5 shown by FIG. 1 to the image forming apparatus 100, and has a switch for detecting whether these memories is connected.

That is, on one hand, when the unit information store use memory 200 or the apparatus information store use memory 300 is connected through the exchanging unit 5 serving as process cartridge is inserted into an insertion section (not shown) of image forming apparatus 100, because the switch is turn on, the external memory I/F 105 generates a switch signal "1" representing that the switch is ON, and sends the switch signal "1" to the CPU 101.

On the other hand, when the unit information store use memory 200 or the apparatus information store use memory 300 is removed through the exchanging unit 5 serving as process cartridge is removed from the insertion section (not shown) of image forming apparatus 100, because the switch is turn off, the external memory I/F 105 generates a switch signal "0" representing that the switch is OFF, and sends the switch signal "0" to the CPU 101.

The CPU 101, when received the switch signal "1", instructs the external memory kind judging section 106 to judge the kind of the external memory.

The unit information store use memory 200, as shown by FIGS. 1 and 3, is mounted on unit body by using a mounting section (not shown) of the exchanging unit 5 serving as process cartridge.

FIG. 7 is a diagram showing a structure of a unit information store use memory in embodiment of the present invention.

Further, the unit information store use memory 200, as shown by FIG. 7, is a non-volatility memory, for example, such as an EEPROM (Electronically Erasable and Programmable Read Only Memory) composed of a memory page 0 having store capacity of 128 bytes, which is formed from an exchanging unit immanent information store area and an exchanging unit use state information store area; and a memory page 1 having store capacity of 8 bytes, which is formed from a memory identification information store area.

Here, when the exchanging unit 5 is delivered to user, it is in a state that the unit information store use memory 200 is mounted on the mounting section of the unit through maker to manufacture the unit. Further, in the embodiment of the present invention, though only an example is shown to use unit information store use memory 200 formed from non-volatility memory, the present invention is not be limited in the example, it is possible to use unit information store use memory 200 formed from a flash memory.

The exchanging unit immanent information store area is a store area to store information previously set by maker to manufacture the exchanging unit 5 serving as process cartridge; as shown by FIG. 7, it is composed of an exchanging unit name store area to store a product name of the exchanging unit 5, a toner filling amount store area to store toner amount filled in the exchanging unit 5, a recycle time store area to store recycle time of the exchanging unit 5, and a manufacture date store area to store a manufacture date of the exchanging unit 5.

The exchanging unit use state information store area is a store area to store information representing use state of the exchanging unit 5 serving as process cartridge in the image forming apparatus 100; as shown by FIG. 7, it is composed of use start date store area to store a use start date of the exchanging unit 5 in apparatus body, an apparatus manufacture number store area to store an apparatus manufacture number of the apparatus body, a toner use amount store area to store a use amount of toner accommodated in the toner tank 53 of apparatus body used in image formation mentioned below, and a unit exchange information store area to store unit exchange information representing whether an exchange of the exchanging unit 5 is necessary or not on the basis of a remainder amount of toner accommodated in the toner tank 53.

Here, the toner use amount is, for example, calculated by using a counting function to count print dot number in an image formation controlled by the print controlling section 108. Further, the unit exchange information becomes "1" representing that unit exchange is necessary, in the case that a toner sensor detects a reminder amount of toner accommodated in the toner tank 53 provided in the exchanging unit 5 and the detected toner reminder amount is a predetermined threshold value or below; or the unit exchange information becomes "0" representing that unit exchange is unnecessary, in the case that the detected toner reminder amount exceeds a predetermined threshold value. When the unit exchange information is "1", the CPU 101 starts corresponding program stored in the ROM 102, and controls a displayer provided in the displaying section 113 to display a notification scene for instructing user to exchange the exchanging unit 5.

The memory identification information store area is a store area to store memory identification information for identifying that the external memory kind judging section 106 is the unit information store use memory 200; as shown by FIG. 7, in order to represent it is the unit information store use memory 200, the memory identification information store area stores exchanging unit ID previously set by maker to manufacture the exchanging unit 5.

The apparatus information store use memory 300 is a non-volatility memory such as EEPROM for storing respective information stored in all store areas of the body non-volatility memory 104 of the apparatus body of the image forming apparatus 100 and log stored in a log store area of the RAM 103

Figure 8:
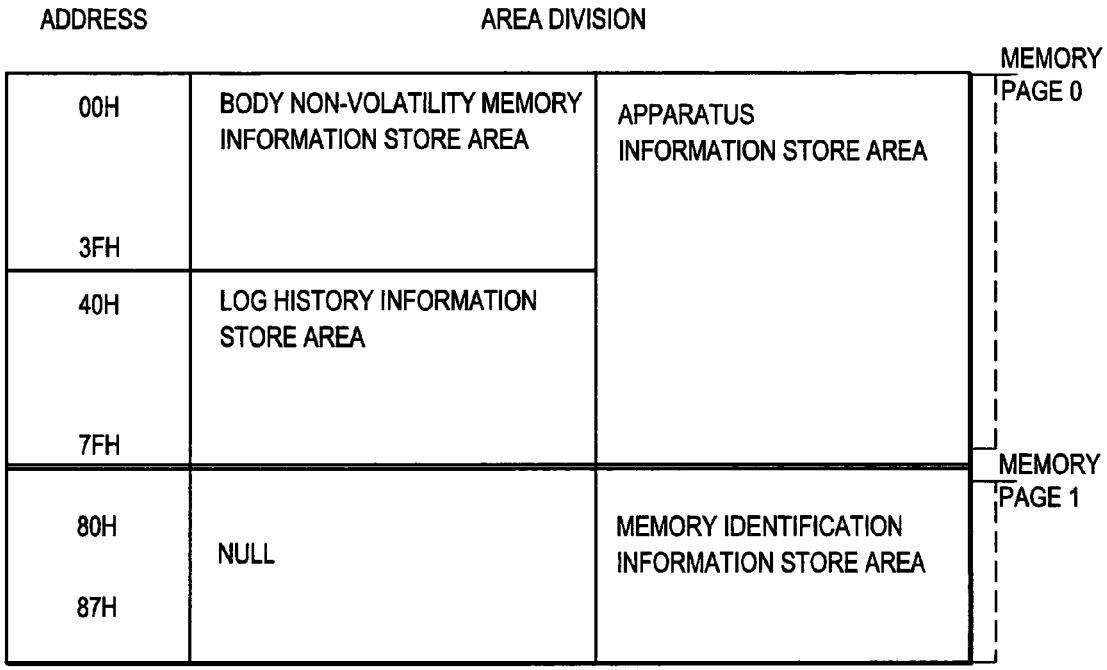
FIG. 8 is a diagram showing a structure of an apparatus information store use memory in embodiment of the present invention.

FIG. 8 is a diagram showing a structure of an apparatus information store use memory in embodiment of the present invention.

As shown by FIG. 8, the apparatus information store use memory 300 is composed of a memory page 0 formed from an apparatus information store area having a store capacity of 128 bytes; and a memory page 1 formed from a memory identification information store area having a store capacity of 8 bytes.

Here, the apparatus information store use memory 300 is an external memory of worker use in order to get the log history information and the hindrance history information stored in the apparatus body, that is used for that the maker to manufacture the image forming apparatus 100 analyzes the reason of failure/repair. That is, when the image forming apparatus 100 occurs hindrance and the worker is dispatched to office to perform restore work or to perform check of maintenance/management, the worker removes the unit information store use memory 200 mounted on the mounting section of the exchanging unit 5, then makes the apparatus information store use memory 300 be mounted on the mounting section. In the embodiment of the present invention, though only an example is shown to use apparatus information store use memory 300 formed from non-volatility memory, the present invention is not be limited in the example, it is possible to use apparatus information store use memory 300 formed from a flash memory.

The apparatus information store area, as shown by FIG. 8, is composed of a body non-volatility memory information store area whose address values are 00H~3FH for storing respective information stored in all store areas of the body non-volatility memory 104; and a log history information store area whose address values are 10H~7FH for storing log history information stored in a log history information store area of the RAM 103.

The memory identification information store area is a store area to store memory identification information for that the external memory kind judging section 106 identifies the apparatus information store use memory 300. In order to represent that it is the apparatus information store use memory 300, for example, as shown FIG. 8, "NULL" is stored.

The external memory kind judging section 106 is a judging section to judge whether the external memory mounted on the exchanging unit 5 is unit information store use memory 200 or apparatus information store use memory 300.

That is, on the one hand, the external memory kind judging section 106 starts the corresponding program stored in the ROM 102 when received an instruction of king judgment of external memory; and judges that it is the unit information store use memory 200 when exchanging unit ID is stored into the store area of addresses of 80H~87H in the external memory mounted on the exchanging unit 5.

On the other hand, the external memory kind judging section 106 judges that it is the apparatus information store use memory 300 when "NULL" is stored into the store area of addresses of 80H~87H in the external memory mounted on the exchanging unit 5.

On the one hand, in the case that the external memory kind judging section 106 judges that it is the unit information store use memory 200, the CPU 101 instructs the new continuance unit judging section 107 to perform a new continuance unit judgment.

On the other hand, in the case that the external memory kind judging section 106 judges that it is the apparatus information store use memory 300, the CPU 101 instructs the body non-volatility memory managing section 112 to store the body non-volatility memory information, and instructs the RAM managing section 110 to store the log history information.

The new continuance unit judging section 107 is a judging section to judge whether the exchanging unit 5 on which the unit information store use memory 200 is mounted and which is inserted in the insertion section (not shown) of the image forming apparatus 100 is a new unit or is a continuance unit which is removed from the insertion section and is reinserted into the insertion section. That is, the new continuance unit judging section 107, when received a instruction to perform a judgment of new continuance unit, searches the use start date store area of the unit information store use memory 200 connected with the external memory I/F 105; when a use start date is not stored in the area, judges that it is new unit.

On the one hand, when the new continuance unit judging section 107 judged that it is a new unit, the CPU 101 stores the date represented by a timer (not shown) in the image forming apparatus 100 into the use start date store area of the unit information store use memory 200, as use start information; and stores the apparatus manufacture number stored in the apparatus manufacture number store area of the body non-volatility memory 104 into the apparatus manufacture number store area of the unit information store use memory 200.

Further, the CPU 101 initializes a total value of print dot number obtained by using a count function to count print dot number in image formation into "0"; and stores a toner use amount of "0" into the toner use amount store area of the unit information store use memory 200. Furthermore, the CPU 101 stores a unit exchange information of "0" into the unit exchange information store area of the unit information store use memory 200. Then, the CPU 101, after stored these information into the exchanging unit use state information store area of the unit information store use memory 200 connected with the external memory I/F 105, moves to a print job wait state.

On the other hand, when the new continuance unit judging section 107 judged that it is a continuance unit, the CPU 101 continue to manage respective information stored in the exchanging unit use state information store area of the unit information store use memory 200 connected with the external memory I/F 105, and moves to a print job wait state.

The CPU 101, when received image data from an upper apparatus via a communicating section (not shown) of image forming apparatus 100, in the case that the external memory kind judging section 106 judged that the unit information store use memory 200 is mounted on the exchanging unit 5, stores the image data into the general-purpose store area of the RAM 103. Then, the CPU 101, after stored the image data into the general-purpose store area of the RAM 103, instructs the print controlling section 108 to perform an image formation.

Further, in the case that the external memory kind judging section 106 judged that the apparatus information store use memory 300 is mounted on the exchanging unit 5, the CPU 101, for example, performs a rejection process to reject the receiving of the image data, starts the corresponding program stored in the ROM 102, generates a maintenance management notification signal to notify that it is impossible to receive image data due to maintenance/management work, and transmits the signal to the upper apparatus.

The print controlling section 108 controls the respective sections of the image forming apparatus 100 shown by FIG. 2 and the respective sections of the exchanging unit 5 serving as process cartridge shown by FIG. 3 to perform an image formation. That is, the print controlling section 108, after received an instruction of image formation, uses the exchanging unit 5 and the other sections in the image forming apparatus 100 to perform the image formation with respect to print medium in the paper feed tray 2 on the basis of the image data stored in the general-purpose store area of the RAM 103.

Here, the print controlling section 108, while performing a print control, updates the value of toner use amount stored in the toner use amount store area of the unit information store use memory 200 on the basis of the total value of dot number counted by a count function in the print controlling section 108 to count dot number used in the image formation.

Then, the print controlling section 108, when received an instruction to stop the image formation process as mentioned below, turns off the power source (not shown) supplied to the respective sections of the image forming apparatus 100 to perform the image formation process and the respective sections of the exchanging unit 5 serving as process cartridge shown by FIG. 3. Then, the respective sections of the image forming apparatus 100 to perform the image formation process and the exchanging unit 5 stop the image formation process.

The log obtaining section 109 is an obtaining section to obtain log representing operation record of the image forming apparatus 100. Then, the log obtaining section 109, after obtained the log, generates a log obtainment signal assigned a log and sends the generated log obtainment signal to the RAM managing section 110 via the CPU 101. Here, regarding the generation of the log, because it is well known, its explanation is omitted.

The RAM managing section 110 is a managing section to manage respective information stored in the general-purpose store area of the RAM 103, and manage log history information stored in the log history information store area. That is, the RAM managing section 110, after received the log obtainment signal, generates log history information corresponding to the log assigned to the log obtainment signal and corresponding to the date serving as a log detection date represented by a timer when the CPU 101 received and detected, and stores the generated log history information into the log history information store area of the RAM 103.

Then, the RAM managing section 110, after received an instruction to store the log history information, stores the log history information that is stored in the log history information store area of the RAM 103 into the log history information store area in apparatus information store area of the apparatus information store use memory 300 connected with the external memory I/F 105 via the CPU 101.

The hindrance detecting section 111 is a detecting section which has respective hindrance detecting sensors (not shown) and respective hindrance judging portions that are furnished in respective sections for detecting hindrances generated in respective sections of apparatus body of the image forming apparatus 100. That is, the hindrance detecting section 111, when detected respective hindrances occurred in respective sections by the respective hindrance detecting sensors and respective hindrance judging portions, generates hindrance detection signals assigned error codes and hindrance names representing respective hindrances corresponding to respective sections, and sends the generated hindrance detection signals to the body non-volatility memory managing section 112 via the CPU 101. Here, as the hindrance detected by the hindrance detecting section 111, it may be, for example, error caused by abnormal high temperature, error caused by fan whose operation is impossible, communication error of LED head and the like.

The CPU 101, when received the hindrance detection signal, performs an instruction to instruction the print controlling section 108 to stop the image formation process; starts the corresponding program stored in the ROM 102; and makes the displayer provided in the displaying section 113 display a notification scene for notifying of the hindrance detection based on the error code and hindrance name assigned to the hindrance detection signal. Then, user refers to the notification scene of hindrance detection displayed on the displayer provided in the displaying section 113 to deal with the hindrance. If the user could not deal with the hindrance, the user requests center to dispatch a worker.

The body non-volatility memory managing section 112 is a managing section to manage respective information stored in the respective store areas of the body non-volatility memory 104. That is, the body non-volatility memory managing section 112, when received the hindrance detection signal, makes the date represented by a timer when the CPU 101 received the signal, as a detection date of hindrance, correspond to the error code and the hindrance name assigned to the hindrance detection signal; then generates hindrance history information; and stores the generated hindrance history information into the hindrance history information store area of the body non-volatility memory 104.

Then, the body non-volatility memory managing section 112, when received an instruction to store body non-volatility memory information, stores all information stored in all store areas of the body non-volatility memory 104 into the apparatus information store use memory 300 connected with the external memory I/F 105 via the CPU 101.

The worker dispatched because of request of user refers to the notification scene of hindrance scene displayed on the displayer provided in the displaying section 113 of the image forming apparatus 100; and, in order to refers to the hindrances generated till the current time, presses a buttons provided in the inputting section 114 to instruct a reading of the hindrance history information. Then, the CPU 101 executes the corresponding program stored in the ROM 102, and displays the hindrance history information notification scene based on the hindrance history information stored in the hindrance history information store area of the body non-volatility memory 104 onto the displayer provided in the displaying section 113. The worker, while referring to the hindrance history information notification scene displayed on the displayer provided in the displaying section 113, deals with the hindrance occurred in the image forming apparatus 100. Here, in the embodiment, such displayer of touch panel type is used, which unifies the buttons provided in the displayer of the displaying section 113 and of the inputting section 114, and has LED lamp.

After the worker ends to deal with the hindrance of the image forming apparatus 100 and makes the apparatus body restore operation, in order to obtain the hindrance history information and the log history information stored in the apparatus body and to be used in reason analysis of failure/repair, the worker takes out the exchanging unit 5 inserted into the insertion section (not shown) of the apparatus body, takes out the unit information store use memory 200 mounted on the mounting section of the exchanging unit 5, and mounts the apparatus information store use memory 300 carried by the worker onto the exchanging unit 5. The exchanging unit 5 on which the apparatus information store use memory 300 is mounted is inserted again into the insertion section of the image forming apparatus 100 by the worker.

The CPU 101, when stored the all information stored in the body non-volatility memory 104 and the log history information stored in the log history information store area of the RAM 103 into the apparatus information store use memory 300 mounted on the exchanging unit 5, starts the corresponding program stored in the ROM 102, and makes the displayer provided in the displaying section 113 display a notification scene for notifying of an end of the store of the apparatus information toward the apparatus information store use memory 300.

The worker grasps the end of the store of the apparatus information toward the apparatus information store use memory 300 through referring to the notification scene displayed on the displayer provided in the displaying section 113, and takes out the exchanging unit 5 inserted in the insertion section (not shown) of apparatus body of the image forming apparatus 100 so as to dismantle the apparatus information store use memory 300 mounted on the unit. Then, the worker mounts the unit information store use memory 200 onto the exchanging unit 5 for replacing the apparatus information store use memory 300, and inserts again the exchanging unit 5 into the insertion section of the image forming apparatus 100. After that, the apparatus information store use memory 300 is sent to maker by the worker, and the maker uses the hindrance history information and the log history information stored in the memory to analyze the reason of the hindrance/repair in the image forming apparatus 100. Here, an example of the log history information is shown by FIGS. 9A and 9B.

FIG. 9A is a diagram showing an example of log history information; and FIG. 9B is a diagram showing an analysis result of the log history information in embodiment of the present invention.

The log history information uses 4 bytes of hexadecimal to represent each operation in the image forming apparatus 100. An analysis executant on the maker side refers to the log history information shown by FIG. 9 and the analysis result of the log history information, and refers to the hindrance history information (not shown) to analyze the reason of hindrance/repair in the image forming apparatus 100.

Operation of Embodiment

The following is to explain operation about the image forming apparatus 100 in the embodiment of the present invention. Here, the image forming apparatus 100 is set into a printer; and the exchanging unit 5 is set into a process cartridge.

Figure 10:
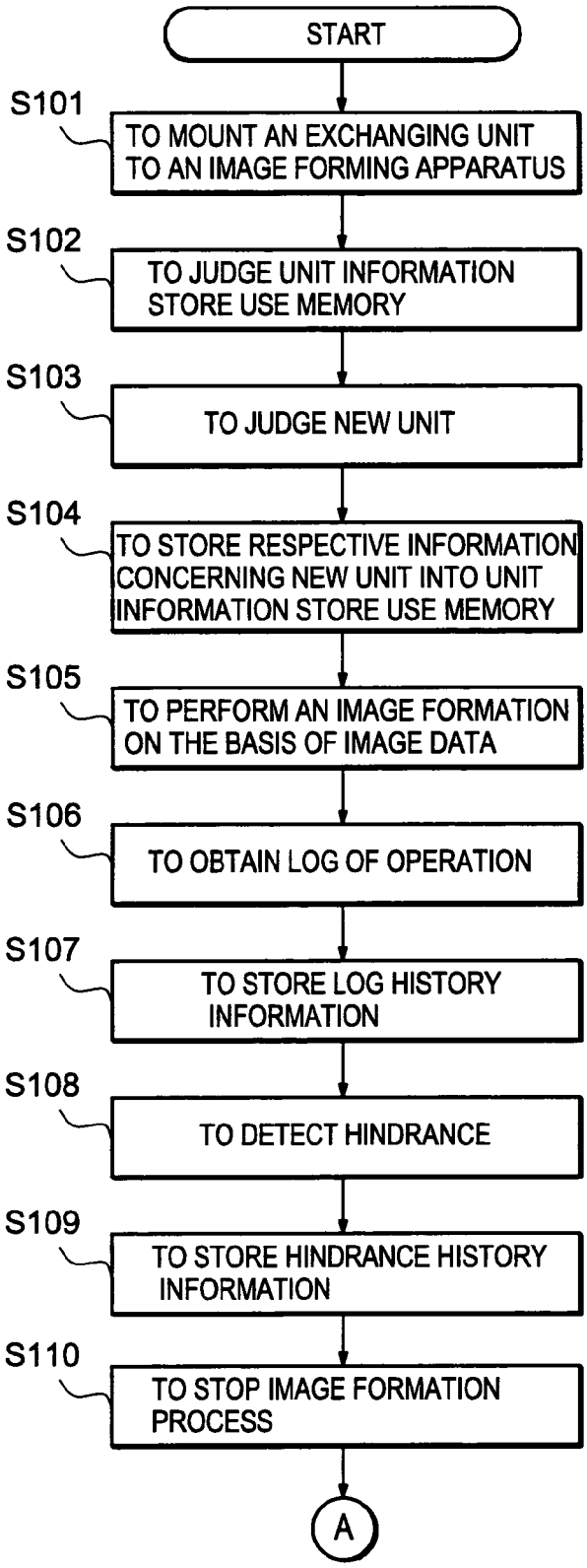
FIG. 10 is a flowchart showing operations till stop of image forming process due to hindrance occurrence of an image forming apparatus in embodiment of the present invention.

FIG. 10 is a flowchart showing operations till stop of image forming process due to hindrance occurrence of an image forming apparatus in embodiment of the present invention.

First is to explain operation of the image forming apparatus 100 from step to insert a new exchanging unit 5 sent from maker into the insertion section (not shown) of the image forming apparatus 100 to step a hindrance occurs in the apparatus.

In the new exchanging unit 5 sent from maker, the unit information store use memory 200 is mounted on the mounting section (not shown) of the unit, the exchanging unit 5 is inserted into the insertion section (not shown) of the image forming apparatus 100 by user.

After the exchanging unit 5 is inserted into the insertion section (not shown) of the image forming apparatus 100, the unit information store use memory 200 mounted on the exchanging unit 5 is connected with the external memory I/F 105 (step S101). Thereby, because the switch provided in the external memory I/F 105 is turned on, the external memory I/F 105 generates a switch signal of "1" representing a switch ON; and sends the switch signal of "1" to the CPU 101.

The CPU 101, after received the switch signal of "1", instructs the external memory kind judging section 106 to judge the kind of the external memory.

The external memory kind judging section 106, after received the instruction to judge the kind of the external memory, starts the corresponding program stored in the ROM 102; because an exchanging unit ID is stored in the store area whose address value are 80H~87H, of the unit information store use memory 200 mounted on the exchanging unit 5, the external memory kind judging section 106 judges that the external memory is the unit information store use memory 200 (step S102).

When the external memory kind judging section 106 judged that the external memory is the unit information store use memory 200, the CPU 101 instructs the new continuance unit judging section 107 to judge whether it is a new unit or continuance unit.

The new continuance unit judging section 107, after received the instruction to judge whether it is a new unit or continuance unit, searches the exchanging unit use state information store area of the unit information store use memory 200 connected with the external memory I/F 105; because a use start date is not stored in the exchanging unit use state information store area, the new continuance unit judging section 107 judges that it is a new unit (step S103).

When the new continuance unit judging section 107 judged that it is a new unit, the CPU 101 stores the date indicated by a timer (not shown) provided in the image forming apparatus 100 into the use start date store area of the unit information store use memory 200, as use start information; and stores the apparatus manufacture number stored in the apparatus manufacture number store area of the body non-volatility memory 104 into the apparatus manufacture number store area of the unit information store use memory 200. Further, the CPU 101 initializes a total value of print dot number obtained by a counting function to count print dot number used in the image formation into "0"; and stores a toner use amount of "0" into the toner use amount store area of the unit information store use memory 200. Furthermore, the CPU 101 stores a unit exchange information of "0" into unit exchange information store area of the unit information store use memory 200 (step S104).

The CPU 101, after stored the respective information into the exchanging unit use state information store area of the unit information store use memory 200 connected with the external memory I/F 105, moves to a print job waiting state.

The CPU 101, when received image data from an upper apparatus via a communication section (not shown) of the image forming apparatus 100, in the case that the external memory kind judging section 106 judged that the unit information store use memory 200 is mounted on the exchanging unit 5, stores the image data into the general-purpose store area of the RAM 103. Then, the CPU 101, after stored the image data into the general-purpose store area of the RAM 103, instructs the print controlling section 108 to perform an image formation.

The print controlling section 108, after received the instruction to perform an image formation, uses the exchanging unit 5 and respective sections in the image forming apparatus 100 to perform the image formation on the basis of the image data stored in the general-purpose store area of the RAM 103 onto the print medium held in the paper feed tray 2 shown by FIG. 2 (step S105).

The log obtaining section 109 obtains a log representing an operation record of the image forming apparatus 100 (step S106); then generates a log obtainment signal assigned the log; and sends the generated log obtainment signal to the RAM managing section 110 via the CPU 101.

The RAM managing section 110, after received the log obtainment signal, makes the log assigned to the log obtainment signal correspond to the date of signal receiving, which, as a detection date of log, is indicated by a timer and is detected by the CPU 101 so as to generate a log history information; and stores the generated log history information into the log history information store area of the RAM 103 (step S107).

When the respective hindrance detecting sensors and the respective hindrance judging sections (not shown) in the hindrance detecting section 111 detected respective hindrances occurred in the respective sections (step S108), the hindrance detecting section 111 generates a hindrance detection signal assigned error codes and hindrance names representing contents of respective hindrances corresponding to the respective sections; and sends the generated hindrance detection signal to the body non-volatility memory managing section 112 via the CPU 101. Here, as the hindrance detected by the hindrance detecting section 111, for example, it may be error caused by abnormal high temperature, error caused by operation impossibility of fan, communication error of LED head.

The body non-volatility memory managing section 112, after received the hindrance detection signal, makes the error code and the hindrance name that are assigned to the hindrance detection signal correspond to the date of signal receiving, which, as a detection date of hindrance, is indicated by a timer and is detected by the CPU 101, so as to generate hindrance history information; and stores the generated hindrance history information to the hindrance history information store area of the body non-volatility memory 104 (step S109).

The CPU 101, when received the hindrance detection signal, instructs the print controlling section 108 to stop image formation process; and starts the corresponding program stored in the ROM 102 so as to make the displayer provided in the displaying section 113 display a notification scene of hindrance detection on the basis of the error code and the hindrance name assigned to the hindrance detection signal.

The print controlling section 108, after received the instruction to stop image formation process, shuts off a supply of power source, outputted from a power source (not shown), toward the respective sections to perform the image formation process in the image forming apparatus 100 and the respective sections of the exchanging unit 5 serving as process cartridge. Thereby, the respective sections to perform the image formation process and the exchanging unit 5 stops the image formation process (step S110).

User deals with the hindrance while referring to the notification scene of hindrance detection displayed on the displayer provided in the displaying section 113 of the image forming apparatus 100. In the case that the user could not to deal with the hindrance, the user requests the center to dispatch a worker.

Next, it is to explain operation of image forming apparatus 100 in the case that the apparatus information store use memory 300 is mounted on the exchanging unit 5 by the worker after the worker dispatched from the center dealt with the hindrance.

Figure 11:
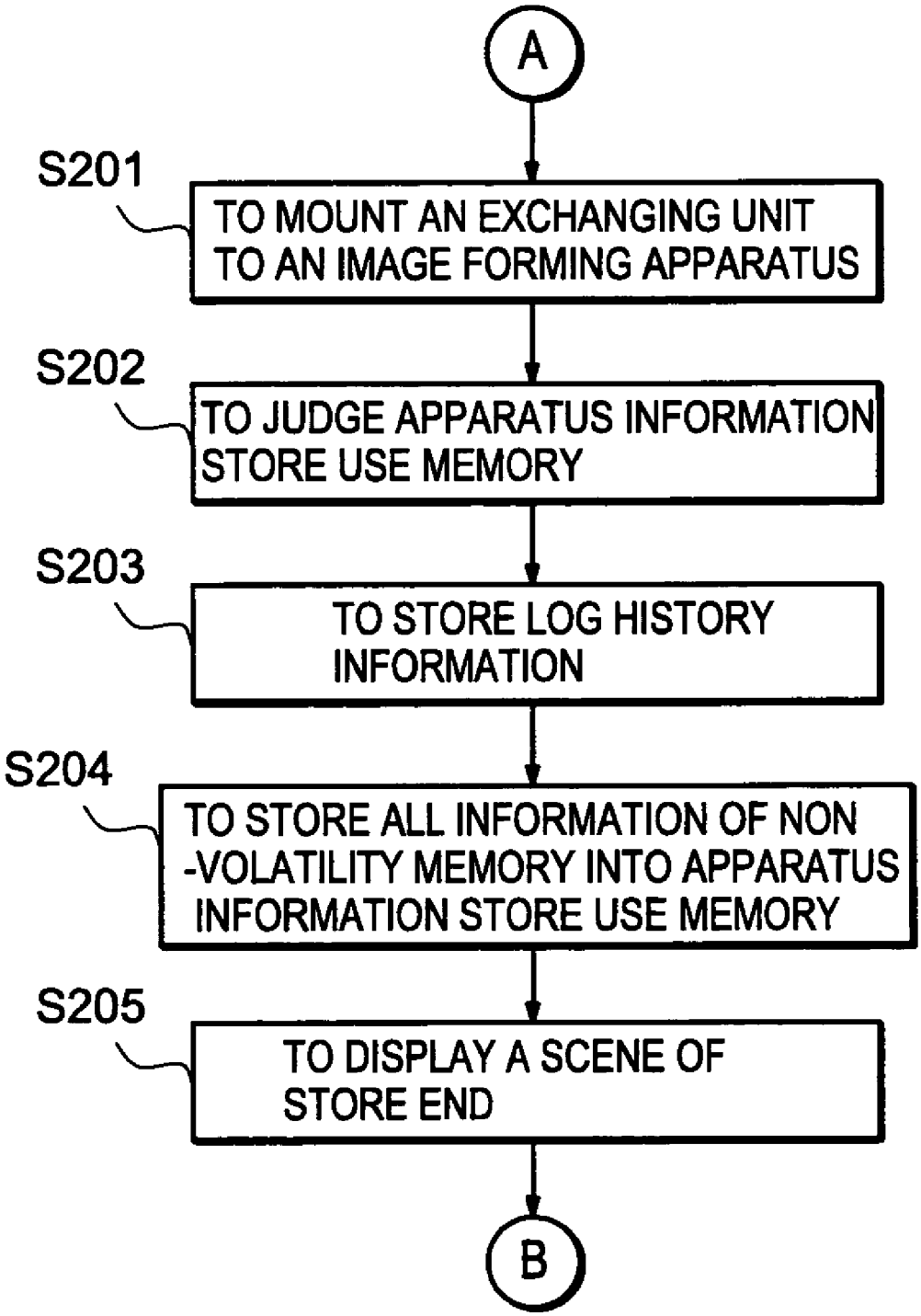
FIG. 11 is a flowchart showing operations in the case that apparatus information store use memory is mounted on an exchanging unit of image forming apparatus in embodiment of the present invention.

FIG. 11 is a flowchart showing operations in the case that apparatus information store use memory is mounted on an exchanging unit of image forming apparatus in embodiment of the present invention.

The worker takes out the exchanging unit 5 serving as process cartridge, inserted in the insertion section (not shown) of the image forming apparatus 100, and removes the unit information store use memory 200 mounted on the exchanging unit 5. Then, the worker mounts the apparatus information store use memory 300 carried by the worker onto the mounting section of the exchanging unit 5, and inserts again the unit into the insertion section (not shown) of the image forming apparatus 100.

After the exchanging unit 5 is inserted into the insertion section (not shown) of the image forming apparatus 100, the apparatus information store use memory 300 mounted on the exchanging unit 5 is connected with the external memory I/F 105 (step S201). Thereby, because the switch provided in the external memory I/F 105 is turned on, the external memory I/F 105 generates a switch signal of "1" representing a switch ON; and sends the switch signal of "1" to the CPU 101.

The CPU 101, after received the switch signal of "1", instructs the external memory kind judging section 106 to judge the kind of the external memory.

The external memory kind judging section 106, after received the instruction to judge the kind of the external memory, starts the corresponding program stored in the ROM 102; because "NULL" is stored in the store area whose address value are 80H~87H, of the apparatus information store use memory 300 mounted on the exchanging unit 5, the external memory kind judging section 106 judges that the external memory is the apparatus information store use memory 300 (step S202).

When the external memory kind judging section 106 judged that the external memory is the apparatus information store use memory 300, the CPU 101 controls the displayer provided in the displaying section 113 to display apparatus information store instruction scene information stored in the ROM 102. When the worker refers to the apparatus information store instruction scene information displayed on the displayer and performs a apparatus information store instruction by using button furnished in the inputting section 114, the CPU 101 instructs the body non-volatility memory managing section 112 to store body non-volatility memory information; and instructs the RAM managing section 110 to store the log history information.

The RAM managing section 110, after received the instruction to store the log history information, stores the log history information stored in the log history information store area of the RAM 103 into the log history information store area in the apparatus information store area of the apparatus information store use memory 300 connected with the external memory I/F 105, via the CPU 101 (step S203).

The body non-volatility memory managing section 112, after received the instruction to store the body non-volatility memory information, stores all information stored in all store areas of the body non-volatility memory 104 into the apparatus information store use memory 300 connected with the external memory I/F 105, via the CPU 101 (step S204).

The CPU 101, after controlled to store the all information stored in the body non-volatility memory 104 and the log history information stored in the log history information store area of the RAM 103 into the apparatus information store use memory 300 mounted on the exchanging unit 5, starts the corresponding program stored in the ROM 102; and controls the displayer provided in the displaying section 113 to display a notification scene for notifying that the store of apparatus information toward the apparatus information store use memory 300 has ended (step S205).

The worker, through referring to the notification scene displayed on the displayer provided in the displaying section 113, grasps that the store of the apparatus information toward the apparatus information store use memory 300 is ended; and takes out the exchanging unit 5 inserted in the insertion section (not shown) of the apparatus body of the image forming apparatus 100, further removes the apparatus information store use memory 300 mounted on the unit. Then, the worker mounts the unit information store use memory 200 onto the exchanging unit 5 to replace the apparatus information store use memory 300, and inserts again the exchanging unit 5 into the insertion section of the image forming apparatus 100.

The last is to explain operation of the image forming apparatus 100 in the case that the exchanging unit 5 on which the unit information store use memory 200 is mounted again by worker is inserted into the insertion section (not shown) of the image forming apparatus 100.

Figure 12:
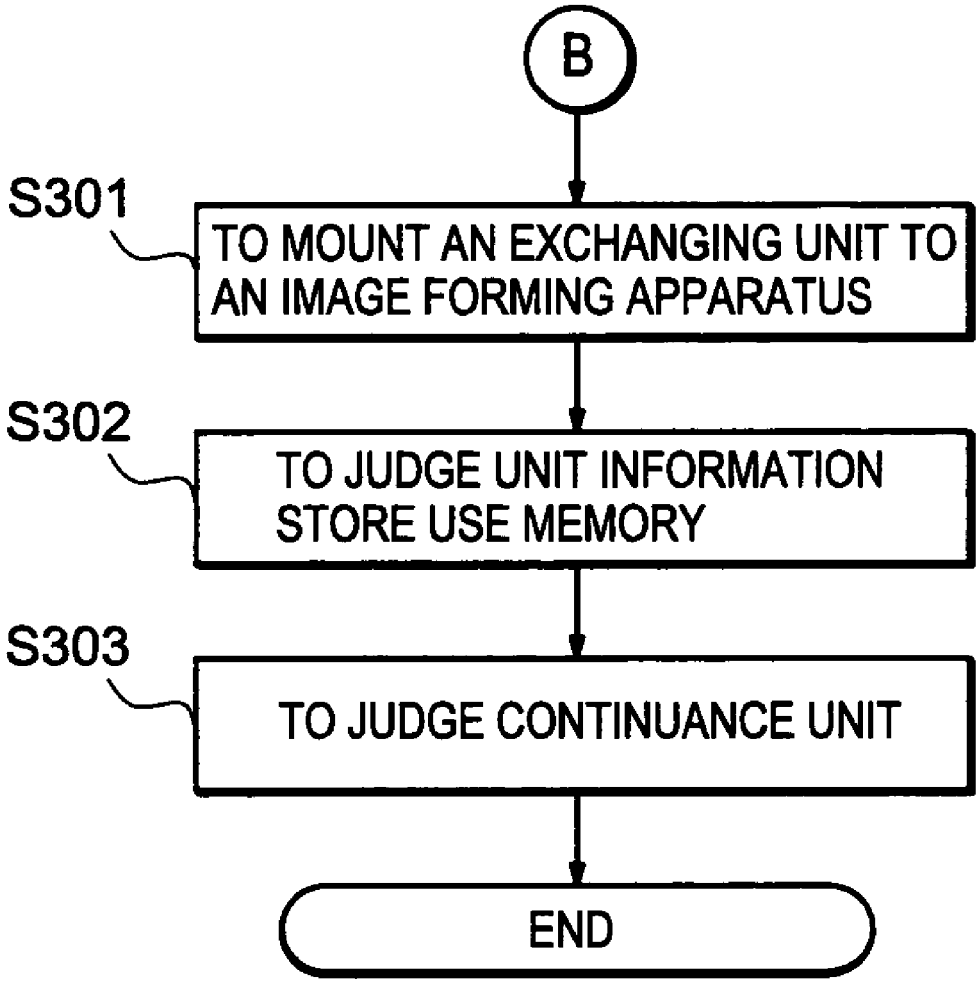
FIG. 12 is a flowchart showing operations in the case that unit information store use memory is mounted again on an exchanging unit of image forming apparatus in embodiment of the present invention.

FIG. 12 is a flowchart showing operations in the case that unit information store use memory is mounted again on an exchanging unit of image forming apparatus in embodiment of the present invention.

After the worker took out the apparatus information store use memory 300 and mounted again the unit information store use memory 200 onto the exchanging unit 5, the exchanging unit 5 is inserted into the insertion section (not shown) of the image forming apparatus 100 by the worker.

After the exchanging unit 5 was inserted into the insertion section (not shown) of the image forming apparatus 100, the unit information store use memory 200 mounted on the exchanging unit 5 is connected with the external memory I/F 105 (step S301). Thereby, because the switch provided in the external memory I/F 105 is turned on, the external memory I/F 105 generates a switch signal of "1" representing a switch ON; and sends the switch signal of "1" to the CPU 101.

The CPU 101, after received the switch signal of "1", instructs the external memory kind judging section 106 to judge the kind of the external memory.

The external memory kind judging section 106, after received the instruction to judge the kind of the external memory, starts the corresponding program stored in the ROM 102; because an exchanging unit ID is stored in the store area whose address value are 80H~87H, of the unit information store use memory 200 mounted on the exchanging unit 5, the external memory kind judging section 106 judges that the external memory is the unit information store use memory 200 (step S302).

When the external memory kind judging section 106 judged that the external memory is the unit information store use memory 200, the CPU 101 instructs the new continuance unit judging section 107 to judge whether it is a new unit or continuance unit.

The new continuance unit judging section 107, after received the instruction to judge whether it is a new unit or continuance unit, searches the exchanging unit use state information store area of the unit information store use memory 200 connected with the external memory I/F 105; because a use start date is stored in the exchanging unit use state information store area, the new continuance unit judging section 107 judges that it is a continuance unit (step S303).

When the new continuance unit judging section 107 judged that it is a continuance unit, the CPU 101 continuously manages the respective information stored in the exchanging unit use state information store area of the unit information store use memory 200 connected with the external memory I/F 105, and moves to a print job waiting state.

After that, the apparatus information store use memory 300 is sent to the maker via the worker; and the maker uses the log history information and the hindrance history information stored in the memory to analyze the reason of failure/repair in the image forming apparatus 100.

Effect of Embodiment

In the image forming apparatus 100 of the embodiment, in order to make the maker obtain the all information stored in the body non-volatility memory 104 of the apparatus body and the log history information stored in the log history information store area of the RAM 103, by the worker, the exchanging unit 5 serving as process cartridge is taken out from the insertion section (not shown) of the apparatus body and the unit information store use memory 200 is mounted on the unit removed, then the apparatus information store use memory 300 is mounted carried by the worker onto the mounting section and the exchanging unit 5 is inserted again into the insertion section of the apparatus body. Thereby, the all information stored in the body non-volatility memory 104 of the image forming apparatus 100 and the log history information stored in the log history information store area of the RAM 103 can be stored into the apparatus information store use memory 300 mounted on the exchanging unit 5 via control of the CPU 101. As a result, it is possible to use a low price structure to make the maker obtain the log history information and the hindrance history information used for reason analysis of failure/repair.

Transform Example

Figure 13:
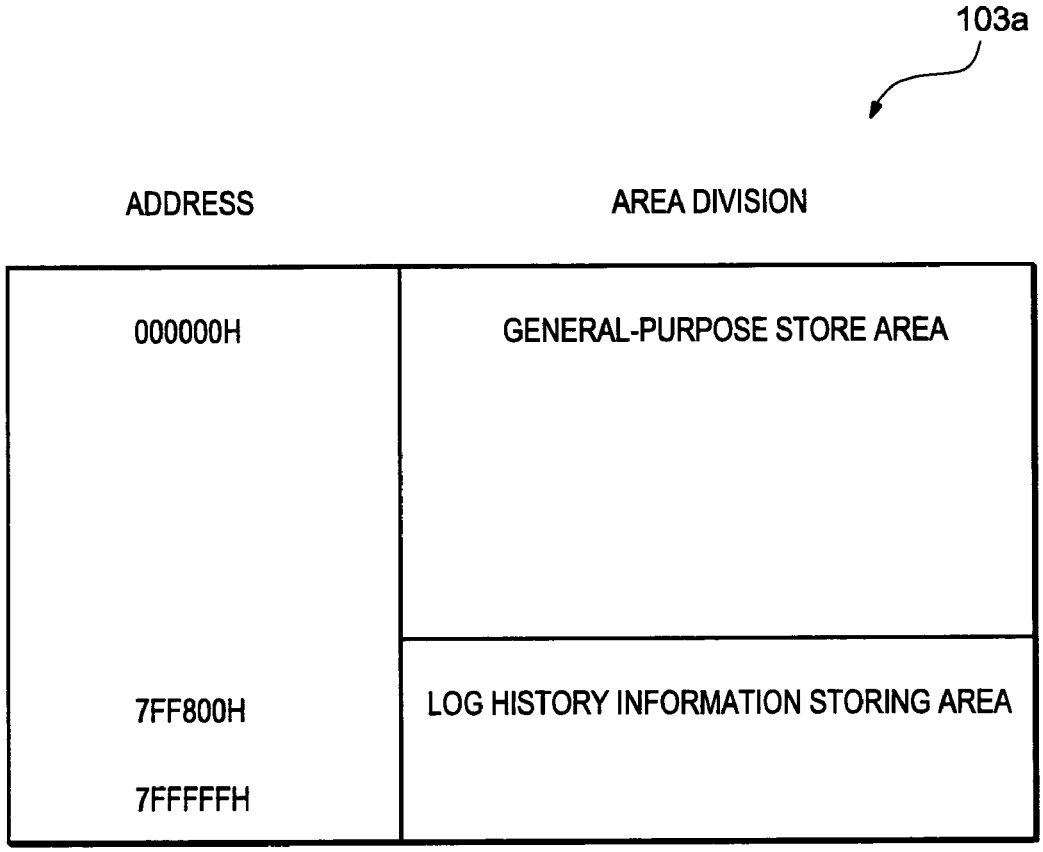
FIG. 13 is a diagram showing a structure of a RAM in transformation example of the present invention.
Figure 14:
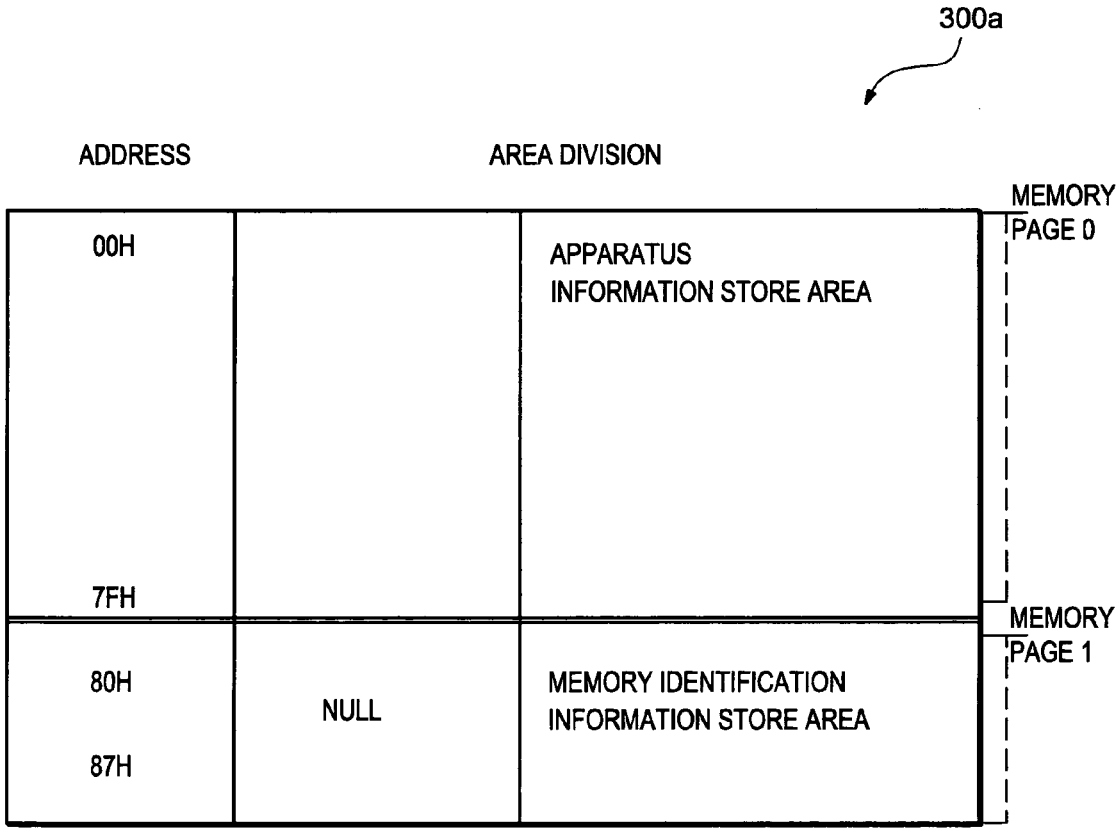
FIG. 14 is a diagram showing a structure of an apparatus information store use memory in transformation example of the present invention.

FIG. 13 is a diagram showing a structure of a RAM in transformation example of the present invention; FIG. 14 is a diagram showing a structure of an apparatus information store use memory in transformation example of the present invention; and FIG. 15 is a diagram showing a structure of a body non-volatility memory in transformation example of the present invention.

In the above stated embodiment, the store capacity of the log history information store area of the RAM 103 in the image forming apparatus 100 is set into 64 bytes. In order to further detail log history information, in an image forming apparatus 100*a* of the transformation example, it is possible to set the store capacity of the store area into larger capacity, for example, 2 kilo-bytes (2048 bytes). The FIG. 13 shows an example of a RAM 103*a* whose log history information store area has a store capacity of 2 kilo-bytes.

In the image forming apparatus 100*a*, instead of the apparatus information store use memory 300 mounted on the exchanging unit 5 of the above-stated embodiment, an apparatus information store use memory 300*a* shown by FIG. 14 can be used which is composed of memory page 0 formed from a apparatus information store area that has a store capacity of 128 bytes but has no a hindrance history information store area and a log history information store area; and of a memory page 1 formed from a memory identification information store area with a store capacity of 8 bytes.

Then, in the image forming apparatus 100*a*, instead of the body non-volatility memory 104 having a store capacity of 64 bytes, a body non-volatility memory 104*a* can be used as shown by FIG. 15, which has a store capacity of 128 bytes.

Figure 16:
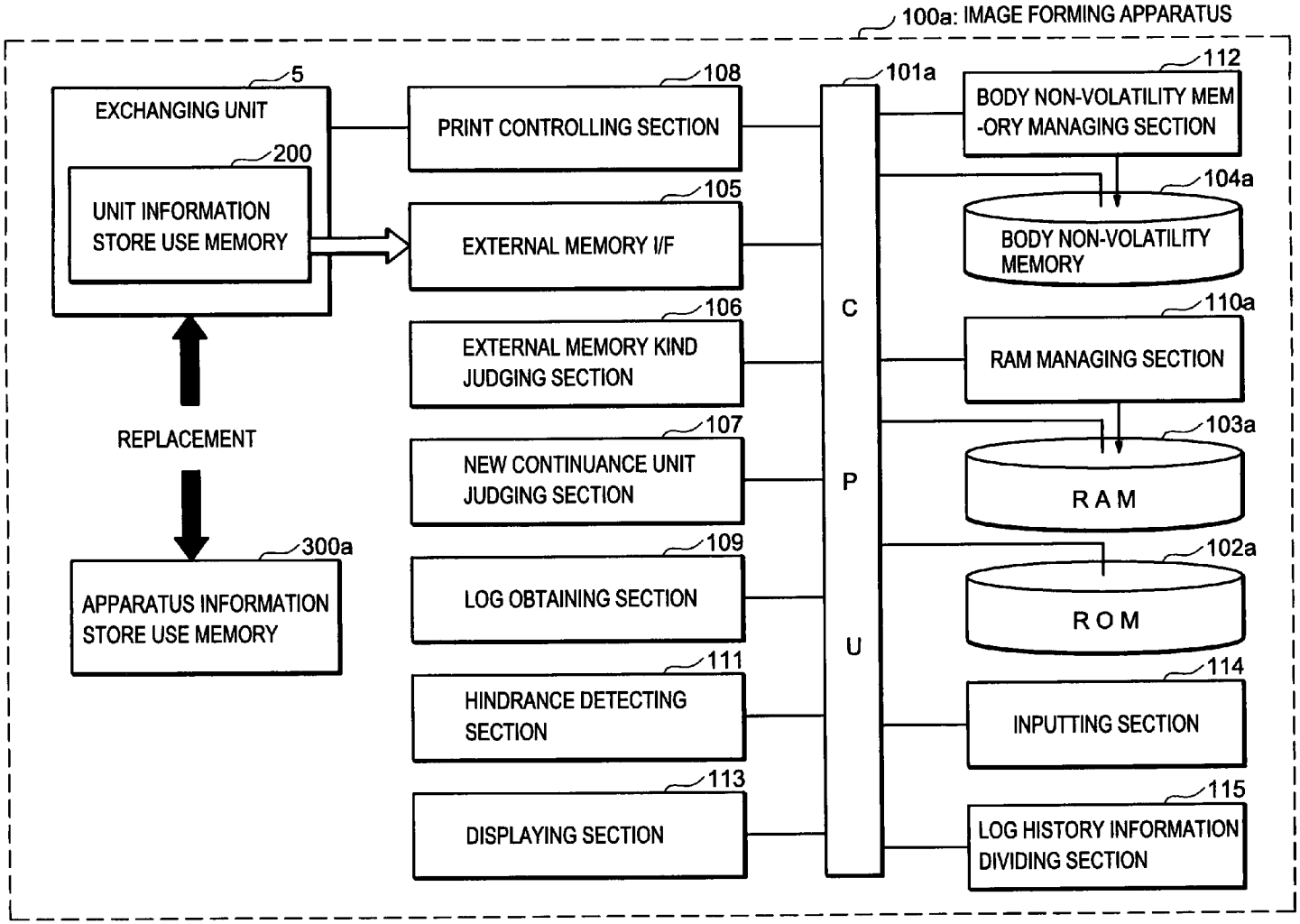
FIG. 16 is a block diagram of an image forming apparatus in transformation example of the present invention.

FIG. 16 is a block diagram of an image forming apparatus in transformation example of the present invention.

The image forming apparatus 100*a* comprises a log history information store area dividing section 115 to divide log history information stored in the RAM 103*a*; and a RAM managing section 110*a* which is got by adding a function into the RAM managing section 110, which is to manage divided log history information stored in a general-purpose store area of the RAM 103*a*. Then, the image forming apparatus 100*a* has a CPU 101*a* which is obtained by adding a function into the CPU 101 of the above stated embodiment, which is to count a mount time number of apparatus information store use memory whenever the external memory kind judging section 106 judged that the apparatus information store use memory 300 is mounted on the exchanging unit 5. Here, the mount time number of apparatus information store use memory is stored in a general-purpose store area of the RAM 103*a*, and is initialized (the mount time number of apparatus information store use memory=0) by the CPU 101*a* when the external memory kind judging section 106 judged that the unit information store use memory 200 is mounted on the exchanging unit 5. Further, the image forming apparatus 100*a* has a ROM 102*a* to store respective programs used for that the CPU 101*a* controls the whole apparatus.

Whenever the worker mounts the apparatus information store use memory 300*a* onto the exchanging unit 5 and inserts the unit into the image forming apparatus 100*a*, and the external memory kind judging section 106 judged that the apparatus information store use memory 300*a* is mounted, the CPU 101*a* performs an increment with respect to the mount time number of apparatus information store use memory.

When the mount time number of apparatus information store use memory becomes "1" by the increment, the CPU 101*a* instructs the body non-volatility memory managing section 112 to store the body non-volatility memory information, and instructs the log history information store area dividing section 115 to divide the log history information.

On the one hand, after the body non-volatility memory managing section 112 stored the all information stored in the all store areas of the body non-volatility memory 104*a* into the apparatus information store use memory 300*a* connected with the external memory I/F 105, the CPU 101*a* starts the corresponding program stored in the ROM 102*a* to control the displayer provided in the displaying section 113 to display a notification scene for notifying that the all information stored in the body non-volatility memory 104*a* has been stored into the apparatus information store use memory 300*a*.

On the other hand, the log history information store area dividing section 115 divides the log history information on the basis of the usable store capacity (128 bytes) of the apparatus information store use memory 300*a*, and generates divided log history information whose maximum division number is 16 parts. Here, the log history information store area dividing section 115, while generating the divided log history information, assigns header information representing a division sequence of respective divided log history information and data flag representing that the divided log history information is final or is not final (when the divided log history information is final, the data flag is "1"; and when the divided log history information is not final, the data flag is "0") to the divided log history information.

After the log history information store area dividing section 115 generated the divided log history information, the RAM managing section 110*a* stores the divided log history information assigned the header information and the data flag into the general-purpose store area of the RAM 103*a* on the basis of an instruction from the CPU 101*a*. Here, the RAM managing section 110*a* manages respective addresses of the divided log history information in the general-purpose store area.

After the worker removed the apparatus information store use memory 300*a* from the exchanging unit 5, which is mounted on the exchanging unit 5 and in which information held in the body non-volatility memory 104*a* is stored; mounts a new apparatus information store use memory 300*a* onto the unit; and inserts the unit into the image forming apparatus 100*a*, the CPU 101*a* performs an increment of the mount time number of apparatus information store use memory.

When the mount time number of apparatus information store use memory exceeds "1" by the increment, the CPU 101*a* instructs the RAM managing section 110*a* to store the divided log history information. The RAM managing section 110*a* stores the divided log history information into the apparatus information store use memory 300*a* connected with the external memory I/F 105 on the basis of the header information and the data flag according to a division sequence. Here, the RAM managing section 110*a*, after stored the divided log history information into the apparatus information store use memory 300*a*, deletes the divided log history information stored in the divided log history information store area of the RAM 103*a*. Thereby, the RAM managing section 110*a* can store the divided log history information into plural apparatus information store use memories 300*a* on the basis of the header information and the data flag according to a division sequence. Further, in the case that the worker carries a information process terminal having an interface section capable of connecting the apparatus information store use memory 300*a*, the worker can repeatedly uses the apparatus information store use memory 300*a* in obtainment process of the divided log history information through storing the divided log history information into the store section of the information process terminal and deleting the divided log history information that has been stored in the apparatus information store use memory 300*a*.

On the one hand, the CPU 101*a*, after stored the divided log history information whose data flag is "0" into the apparatus information store use memory 300*a* connected with the external memory I/F 105, notifies that the divided log history information has been stored into the apparatus information store use memory 300*a*; and controls the displayer provided in the displaying section 113 to display a notification scene for instructing to mount a new apparatus information store use memory 300*a* onto the exchanging unit 5 in order to store the next divided log history information. Here, instead of the notification scene on the displayer, the CPU 101*a* may switch preset LED lamp on or off so as to notify that the store process of the divided log history information is not ended.

On the other hand, the CPU 101*a*, after stored the divided log history information whose data flag is "1" into the apparatus information store use memory 300*a*, starts the corresponding program stored in the ROM 102*a*, and controls the displayer provided in the displaying section 113 to display a notification scene for notifying that all divided log history information stored in the general-purpose store area of the RAM 103*a* have been stored into the apparatus information store use memory 300*a*. Here, instead of the display of the notification scene on the displayer, the CPU 101*a* may switch LED lamp to turn on or off, that is, when to store the divided log history information whose data flag is "0", the LED lamp is turn on; and when to store the divided log history information whose data flag is "1", the LED lamp is turn off. Further, the CPU 101*a* also may use speaker (not shown) in image forming apparatus 100*a* to sound an alarm so as to notify of the end of store.

Then, in the case that the maker uses an information process terminal to obtain the divided log history information generated in the image forming apparatus 100*a* from the apparatus information store use memory 300*a*, the information process terminal judges a coupling sequence of the divided log history information on the basis of the header information and the data flag assigned to the respective divided log history information; after obtained the all divided log history information, couples the all divided log history information together; then deletes the respective header information and the data flags so as to generate the original log history information.

Effect of Transformation Example

In the image forming apparatus 100*a* of the transformation example, because the log history information store area dividing section 115 divides the log history information stored in the log history information store area of the RAM 103*a* into plural divided log history information and these divided log history information are stored into apparatus information store use memory 300*a* on the basis of the division sequence whenever the exchanging unit 5 on which the apparatus information store use memory 300*a* is mounted is inserted into the apparatus body, even if the store capacity of the log history information store area of the RAM 103*a* exceeds the usable store capacity of the apparatus information store use memory 300*a*, the maker can obtain the log history information by using the apparatus information store use memory 300*a*.

Moreover, in the above stated embodiment, the exchanging unit ID is stored in the memory identification information store area of the unit information store use memory 200 by the maker to manufacture the exchanging unit 5, and the external memory kind judging section 106 judges that the memory mounted on the exchanging unit 5 is which of the unit information store use memory 200 and the apparatus information store use memory 300 on the basis of the respective information stored in the respective memory identification information store areas. However, such judgment also may be performed through use the inputting section 114 to make the worker input an instruction.

THE UTILIZATION POSSIBILITY IN INDUSTRY

In the above stated explanation, only such case is explained that the present invention is applied to a printer. However, the present invention is not limited in the case, the present invention also can be applied to various devices such as scanner, copying apparatus, facsimile apparatus, multiplex apparatus having two functions or over (i.e. MFP: Multi Function Products) and the like.

The present invention is not limited to the foregoing embodiment or example but many modifications and variations are possible within the spirit and scope of the appended claims of the invention.

What is claimed is:

1. An image forming apparatus which forms images using an exchangeable unit having a mounting section to mount a unit information store use memory, unit information including use status of the exchangeable unit being stored in the unit information store use memory, said image forming apparatus comprising:

a memory that includes a hindrance history information storing section in which history information about malfunctions of the image forming apparatus is stored;

an external memory interface to which either the unit information store use memory or an apparatus information store use memory can be coupled;

a judging section which judges whether or not any one of the unit information store use memory and the apparatus information store use memory is coupled to the external memory interface; and a controlling section which controls the apparatus information store use memory to store the history information from the memory when the judging section judges that the apparatus information store use memory is coupled to the external memory interface, and which controls the unit information store use memory to store information about the exchangeable unit when the judging section judges that the unit information store use memory is coupled to the external memory interface.

2. The image forming apparatus according to claim 1, wherein the memory additionally stores operation history information representing an operation log of the image forming apparatus.

3. The image forming apparatus according to claim 1, wherein the exchangeable unit is a process cartridge.

4. The image forming apparatus according to claim 1, wherein the exchangeable unit includes a toner cartridge.

5. The image forming apparatus according to claim 1, wherein the exchangeable unit includes an ink cartridge.

6. The image forming apparatus according to claim 1, wherein the apparatus information store use memory is an EEPROM.

7. The image forming apparatus according to claim 1, wherein the apparatus information store use memory is a flash memory.

8. The image forming apparatus according to claim 1, wherein the memory additionally stores a log of the image forming apparatus.

9. The image forming apparatus according to claim 1, further comprising:

a history information dividing section which divides the history information into plural divided history information on the basis of a usable capacity of the of the apparatus information store use memory when an amount of the history information exceeds the usable capacity of the apparatus information store use memory; and a divided history information storing section which stores the plural divided history information, wherein the controlling section controls the apparatus information store use memory to sequentially store the respective divided history information whenever the apparatus information store use memory is coupled to the external memory interface.

10. The image forming apparatus according to claim 9, wherein the history information divided section generates the divided history information which is assigned a header information representing a division sequence, and a flag information representing whether the divided history information is final or not.

11. The image forming apparatus according to claim 1, wherein the image forming apparatus further comprises an apparatus body, and wherein the judging section performs the judgment when the exchangeable unit is mounted on the apparatus body.

12. The image forming apparatus according to claim 1, wherein the controlling section prevents reception, by the image forming apparatus, of image data from an upper apparatus when the apparatus information store use memory is received by the external memory interface.

13. The image forming apparatus according to claim 12, wherein the image forming apparatus notifies the upper apparatus that maintenance work is being performed when the apparatus information store use memory is received by the external memory interface.

* * * * *